US006719056B2

(12) United States Patent
Hoffman et al.

(10) Patent No.: US 6,719,056 B2
(45) Date of Patent: Apr. 13, 2004

(54) SAND REMOVAL METHOD

(75) Inventors: Corey E. Hoffman, Magnolia, TX (US); Richard Lee Giroux, Katy, TX (US); Mike A. Luke, Houston, TX (US); Stephen J. Norris, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/388,869

(22) Filed: Mar. 14, 2003

(65) Prior Publication Data

US 2003/0226664 A1 Dec. 11, 2003

Related U.S. Application Data

(62) Division of application No. 10/163,814, filed on Jun. 6, 2002, now Pat. No. 6,640,904, which is a division of application No. 09/536,937, filed on Mar. 27, 2000, now Pat. No. 6,427,776.

(51) Int. Cl.[7] ..... E21B 37/00
(52) U.S. Cl. ..... 166/312; 166/301
(58) Field of Search ..... 166/311, 312, 166/301, 222, 167, 169, 242.2

(56) References Cited

U.S. PATENT DOCUMENTS

| | | | | |
|---|---|---|---|---|
| 2,797,755 | A | 7/1957 | Bobo | 166/99 |
| 3,023,810 | A | 3/1962 | Anderson | 166/99 |
| 4,276,931 | A | 7/1981 | Murray | 166/99 |
| 4,505,341 | A | 3/1985 | Moody et al. | 175/65 |
| 5,055,002 | A | 10/1991 | Roeder | 417/172 |
| 5,086,842 | A | 2/1992 | Cholet | 166/312 |
| 5,095,976 | A | 3/1992 | Appleton | 166/105.1 |
| 5,176,208 | A | 1/1993 | Lalande et al. | 166/99 |
| 5,280,825 | A | 1/1994 | Cholet | 166/311 |
| 5,372,190 | A | 12/1994 | Coleman | 166/68 |
| 5,562,161 | A | 10/1996 | Hisaw et al. | 166/372 |
| 5,785,124 | A | 7/1998 | Hisaw et al. | 166/372 |
| 5,806,599 | A | 9/1998 | Hisaw et al. | 166/372 |
| 5,944,100 | A | 8/1999 | Hipp | 166/99 |
| 6,158,512 | A | 12/2000 | Unsgaard | 166/311 |
| 6,427,776 | B1 | 8/2002 | Hoffman et al. | 166/311 |

FOREIGN PATENT DOCUMENTS

| | | | |
|---|---|---|---|
| WO | WO 99/22116 | 5/1999 | E21B/37/00 |

*Primary Examiner*—Zakiya Walker
(74) *Attorney, Agent, or Firm*—Moser, Patterson & Sheridan, L.L.P.

(57) ABSTRACT

The present invention provides a simple debris removal apparatus for use in a wellbore. In one aspect of the invention a modular, interchangeable venturi is provided which can be retrofit into an existing debris bailer having a filter and a debris collection container. In another aspect of the invention, a venturi is utilized to create a negative pressure in a wellbore sufficient to actuate a retrieval tool for a downhole device. In yet another aspect of the invention, a combination tool is provided which can evacuate debris in a wellbore, thereby uncovering a downhole device which can then be removed in a single trip. In yet another aspect of the invention, a debris removal apparatus is provided with a method for the apparatus in a wellbore on coiled tubing.

1 Claim, 14 Drawing Sheets

SAND REMOVAL METHOD

CROSS-REFERENCE TO RELATED APPLICATIONS

This application is a divisional of U.S. patent application Ser. No. 10/163,814, filed Jun. 6, 2002, now U.S. Pat. No. 6,640,904, which is a divisional of U.S. patent application Ser. No. 09/536,937, filed Mar. 27, 2000, now U.S. Pat. 6,427,776. Each of the applications is herein incorporated by reference.

BACKGROUND OF THE INVENTION

1. Field of the Invention

The present invention relates to an apparatus for removing sand and other debris from a wellbore; more particularly, the invention relates to apparatus and methods for use in a wellbore utilizing a venturi.

2. Background of the Related Art

In the production of oil and gas, sand breaks loose from oil producing formations and is carried into the wellbore with production fluid. As the production rate of oil increases, the formation sand which breaks loose and enters the wellbore also increases. Over time, the wellbore can become filled and clogged with sand making efficient production of the well increasingly difficult. In addition to sand from the formation, other debris including scale, metal shavings and perforation debris collects in the wellbore and interferes with production.

One method of removing debris from a wellbore involves the introduction of liquid which is circulated in the well. For example, liquid can be pumped down the wellbore through a pipe string and convey debris to the surface of the well upon return through an annulus formed between the pipe string and the wall of the wellbore. Nitrogen or some other gas can be added to the liquid to create a foam for increasing the debris carrying ability of the liquid. However, a relatively small amount of debris is actually conveyed to the well surface and removed in this manner because of the relatively large volume of space in a wellbore that must be filled with sand bearing liquid.

Another prior art method for removing debris from a well includes lowering a container into the well which is filled with debris and then removed. Typically, the container is sealed at the well surface and an atmospheric chamber formed therein. When the chamber is lowered into the well and opened, the pressure differential between the interior of the container and the wellbore causes the wellbore contents, like debris to be surged into the container. While this method of debris removal is effective, the amount of debris removed is strictly limited by the capacity of the container and in practice is typically not more than 85% of the chamber volume. Additionally, the container must be continuously lowered into the well, filled due to pressure differential, raised from the well and emptied at the well surface.

More recently, a nozzle or other restriction has been utilized in the wellbore to increase circulation of a liquid and to cause, by low pressure, a suction thereunder to collect or "bail" debris. The use of a nozzle in a pressurized stream of fluid is well known in the art and operates according to the following principles: The nozzle causes pressurized liquid pumped from the surface of the well to assume a high velocity as it leaves the nozzle. The area proximate the nozzle experiences a drop in pressure. The high velocity fluid from the nozzle is diverted out of the tool and the low pressure area creates a vacuum in the tool below the nozzle, which can be used to create a suction and pull debris from a well along with fluid returning to the high velocity stream. By the use of a container, the debris can be separated from the flow of fluid, collected and later removed from the well. A prior art tool utilizing a nozzle and a diverter is illustrated in FIG. 1. The device 100 includes a nozzle portion 105, a diverter portion 110, a container 120 for captured debris and one way valve 125 to prevent debris from returning from the tool to the wellbore 130. A filter is provided above the container but is designed to prevent the passage of particles larger than grains of sand. While the fluid pumped through the nozzle creates a low pressure and suction therebelow, this design is only marginally effective and the suction created in the tool results in only a partially filled container of debris. For example, experiments measuring the effectiveness of the prior art design of FIG. 1 have resulted in a measured suction of only 3–5" of mercury.

Another apparatus for the removal of debris utilizes a venturi and is described in International Publication No. WO 99/22116 which is incorporated herein in its entirety by reference. The venturi utilizes a nozzle like the one illustrated in prior art FIG. 1. In additional to the nozzle, the venturi includes a throat portion and a diffuser portion to more effectively utilize the high velocity fluid to create a low pressure area and a suction therebelow. The apparatus of the '116 publication, like the device of FIG. 1 also includes a container for holding captured debris wherein the debris enters a flapper valve at the bottom of the container which fills with debris due to suction created by the venturi and is later removed from the well to be emptied at the well surface. While this arrangement is more effective than the one illustrated in FIG. 1, the mechanism is complex and expensive since each part of the device is specially fabricated and the parts are not interchangeable. Most importantly, the nozzle provided with the device is often too small to pass debris carried by the power fluid, clogging the nozzle and making the device useless. Additionally, the size of the container in the prior art devices is fixed limiting the flexibility of the tools for certain jobs requiring large capacity containers.

Aside from simply clearing debris to improve flow of production fluids, debris removal tools can be used to clear debris that has collected in a wellbore over the top of a downhole device, exposing the device and allowing its retrieval and return to the well surface. For example, a bridge plug may be placed in a wellbore in order to isolate one formation from another or a plug maybe placed in a string of tubular to block the flow of fluid therethough. Any of these downhole devices can become covered with debris as it migrates into the wellbore, preventing their access and removal. Removing the debris is typically done with a debris removal device in a first trip and then, in a separate trip, a device retrieval tool is run into the well. This process is costly in terms of time because of the separate trips required to complete the operation.

Debris removal is necessary in any well, whether live and pressurized or dead. In a live well, problems associated with the prior devices are magnified. Circulating fluid through a live well requires a manifold at the well surface to retain pressure within the wellbore. Use of an atmospheric chamber in a live well requires a pressure vessel or lubricator at the well surface large enough to house the atmospheric chambers.

There is a need for debris removal tool utilizing a high velocity fluid stream which effectively removes debris from a wellbore. There is a further need for a debris removal tool that can utilize interchangeable parts depending upon the quality of debris to be removed. There is a further need for a device retrieval tool which can also be used in a single trip to retrieve a downhole device as well as remove debris. There is yet a further need for a debris removal tool with an adjustable container formed of coiled tubing. There is a further need for a method of debris removal and device retrieval in a live well.

SUMMARY OF THE INVENTION

The present invention provides a simple debris removal apparatus for use in a wellbore. In one aspect of the invention a modular, interchangeable venturi is provided which can be retrofit into an existing debris bailer having a filter and a debris collection container. The venturi module replaces a simple and ineffective nozzle and results in a much more effective bailing apparatus. In another aspect of the invention, a venturi is utilized to create a negative pressure in a wellbore sufficient to actuate a retrieval tool for a downhole device. In yet another aspect of the invention, a combination tool is provided which can evacuate debris in a wellbore, thereby uncovering a downhole device which can then be removed in a single trip. In yet another aspect of the invention, a debris removal apparatus is provided with a method for utilizing the apparatus in a wellbore on coiled tubing. In yet another aspect of the invention a debris removal apparatus is provided which can be run on coiled tubing in a live well using a method of selective isolation and pressure bleed off. In yet another aspect, the invention utilizes a section of coiled tubing for a debris container whereby the coiled tubing can be sized depending upon the amount of debris to be removed in the operation.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
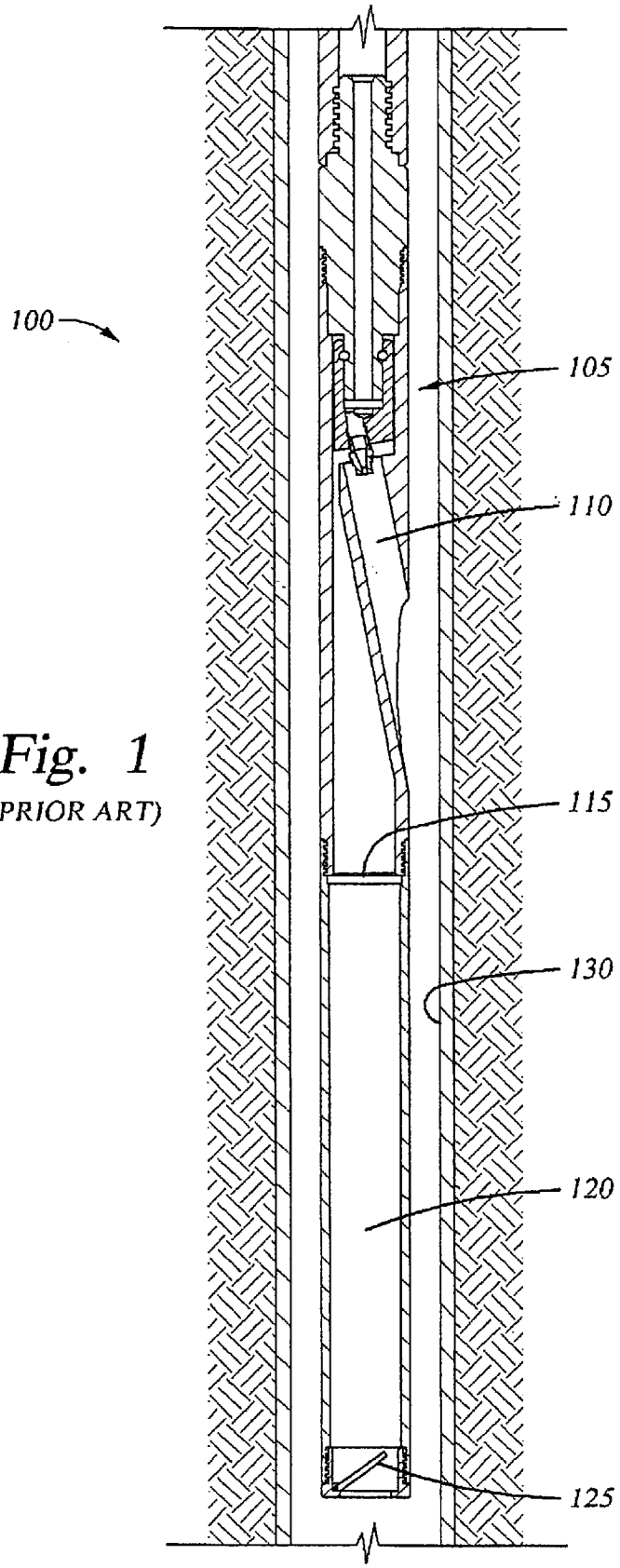
Fig. 1 (PRIOR ART)
FIG. 1 is a prior art debris removal tool having a simple nozzle to increase velocity of a fluid therein to create a suction in the tool therebelow.
Figure 2:
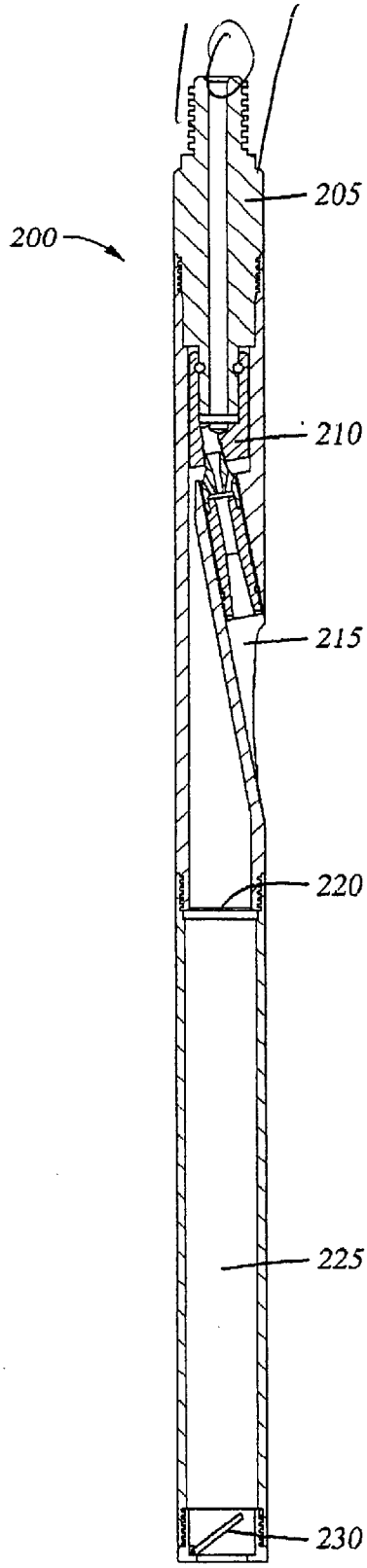
FIG. 2 is a section view of the debris removal tool of the present invention showing a venturi in a diverter portion in the tool.
Figure 3:
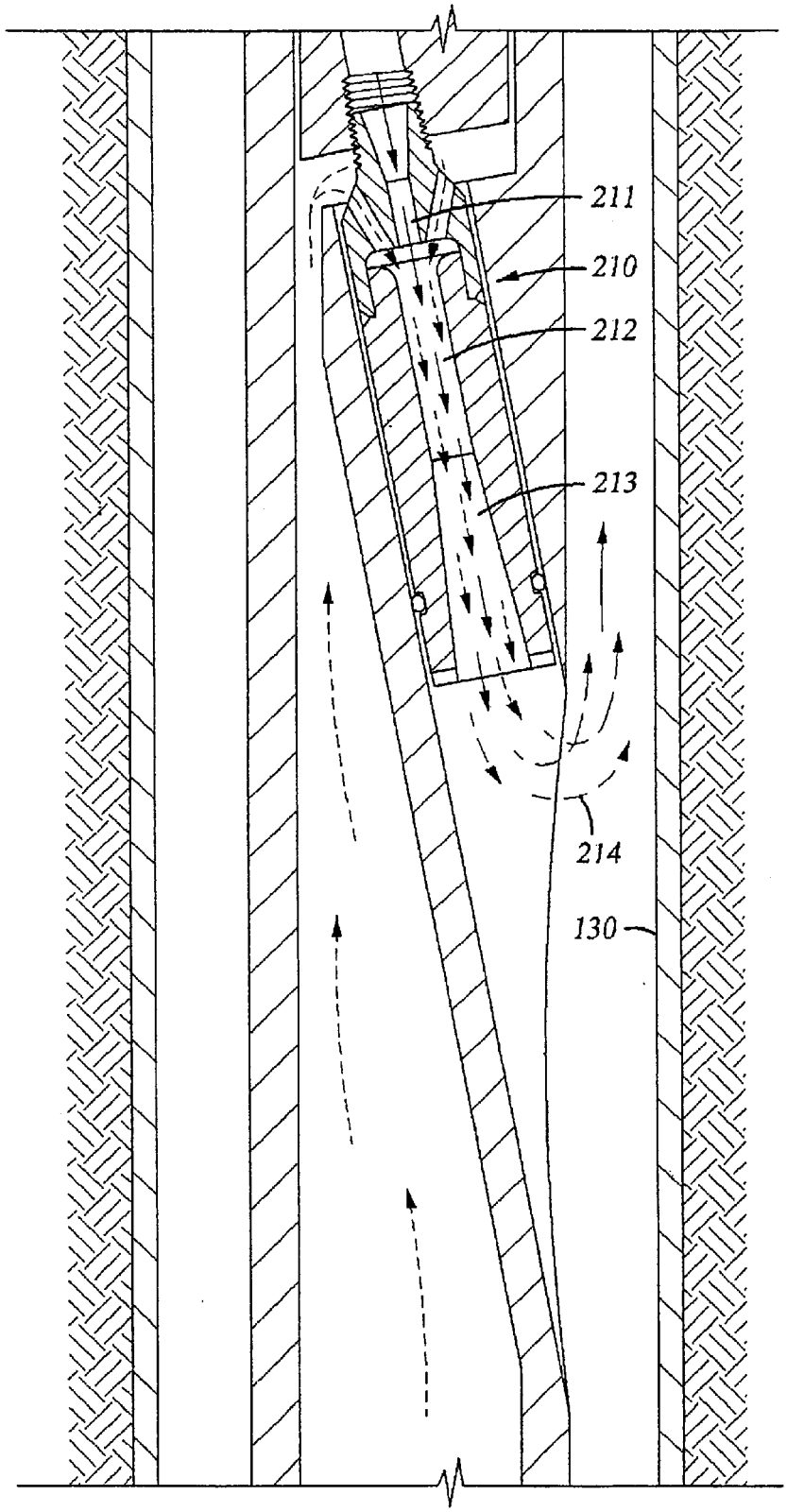
FIG. 3 is an enlarged view of the venturi portion of the tool showing the flow direction of fluid therethrough.
Figure 4:
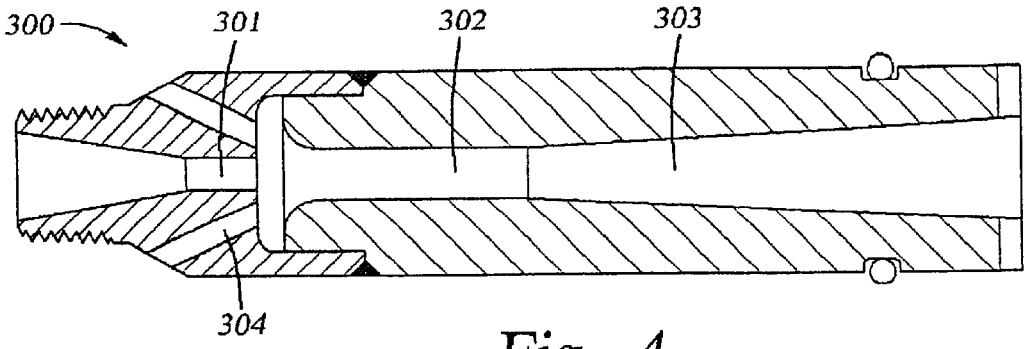
FIG. 4 is a section view showing one dimensional design of the venturi portion of the tool.
Figure 5:
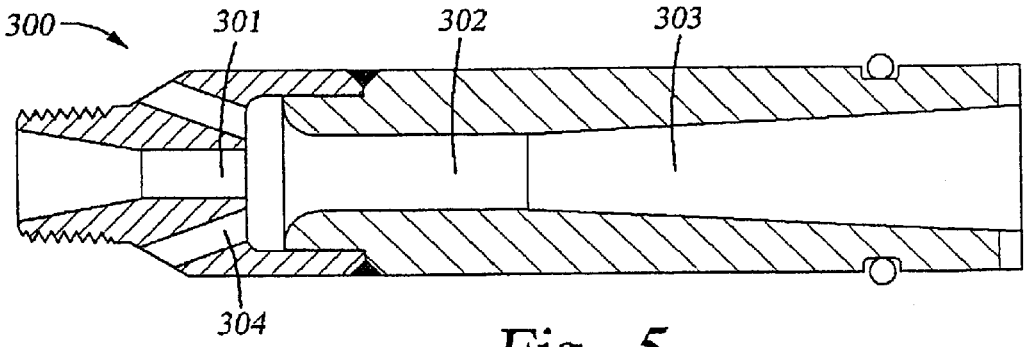
FIG. 5 is a section view showing one dimensional design of the venturi portion of the tool.
Figure 6:
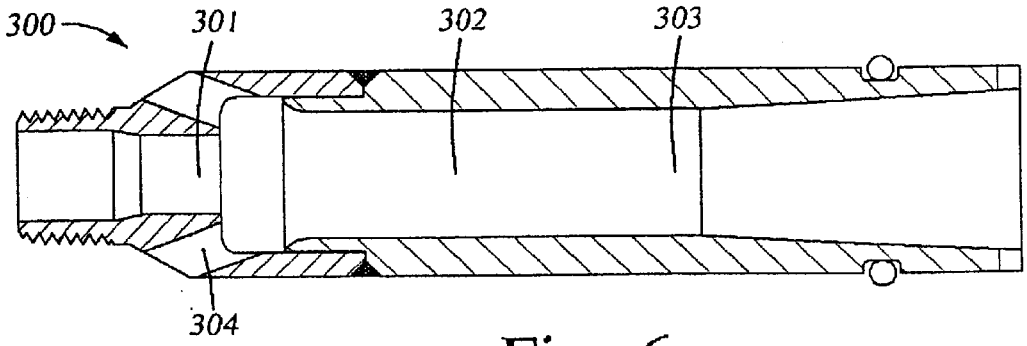
FIG. 6 is a section view showing one dimensional design of the venturi portion of the tool.
Figure 7:
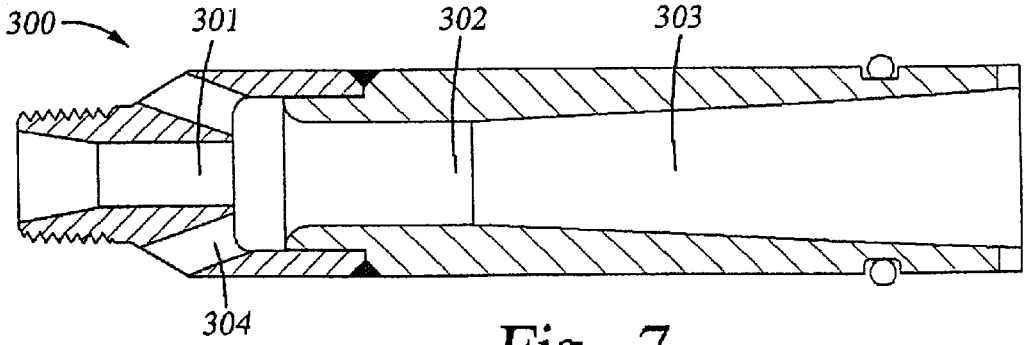
FIG. 7 is a section view showing one dimensional design of the venturi portion of the tool.

FIG. 2 is a section view of a debris bailer tool 200 of the present invention. The tool includes an upper portion 205, a venturi portion 210, a diverter portion 215, a debris screen or filter portion 220 and a debris container 225 including a flapper or ball valve 230 at a lower end thereof. The filter portion 220 is replaceable and is designed to separate debris as small as sand particles from return fluid passing from the container to the venturi portion. In the one embodiment for example, the filter removes particles as small as 8 microns. Depending upon well conditions and the needs of the operator, the screen can be sized for the debris expected to be encountered in the wellbore as well as the type of fluid in the wellbore. For example, some drilling muds will clog a fine screen, but will flow easily through a screen with larger openings therein. The tool 200 operates by the injection of fluid into the upper portion 205 where the fluid travels to the venturi portion 210 and the velocity of the fluid increases as it passes through the nozzle and is then diverted outside of the tool. In the preferred embodiment, the upper portion of the venturi is threaded allowing easy replacement of the venturi for different debris removal operations or a retro fitting of the venturi portion into a prior art tool like the one shown in FIG. 1. FIG. 3 is an enlarged view of the venturi portion of the tool. The venturi includes a nozzle 211, throat 212 and a diffuser 213.

According to the principals of a venturi device, high pressure power fluid passing through the nozzle has its potential energy (pressure energy) converted to kinetic energy in a jet of fluid at high velocity. The power fluid can be made up of a liquid like water or a foam or even a gas. Well fluid mixes with the power fluid in a constant area throat and momentum is transferred to the well fluid, causing an energy rise in the well fluid. As the mixed fluids exit the throat, they are still at the high velocity, and thus contain substantial kinetic energy. The fluids are slowed in an expanding area diffuser that converts the remaining kinetic energy to static pressure sufficient to lift fluids and with them debris, to a containment member in the tool. The arrows 214 in FIG. 3, illustrate the flow of fluid through and around the venturi. Return fluid is recirculated into the nozzle through ports 304. In a well setting, the device creates a vacuum and fluid and debris are drawn into the container portion of the tool.

FIGS. 4–7 are section views of the venturi portion of the device and illustrate a variety of physical nozzle, throat return port and diffuser sizes to determine flow rates therethrough. In every example, the venturi 300 includes a nozzle 301, a throat 302 and a diffuser 303 portion. If a throat size is selected such that the area of the nozzle is 60% of the throat area, a relatively high head, low flow rate will result. Adversely, if a throat is selected such that the area of the nozzle is only 20% of the throat area, more well fluid flow is possible. However, since the nozzle energy is being transferred to a large amount of production compared to the power fluid rate, lower heads will be developed. Design variables include the size of the nozzle and throat and the ratios of their flow areas, as well as component shapes, angles, lengths, spacing, finishes and materials. Through selection of appropriate flow areas and ratios, the venturi configuration can be optimized to match well conditions. Most importantly, a nozzle size can be selected to pass debris that may be present in the power fluid.

Figure 8:
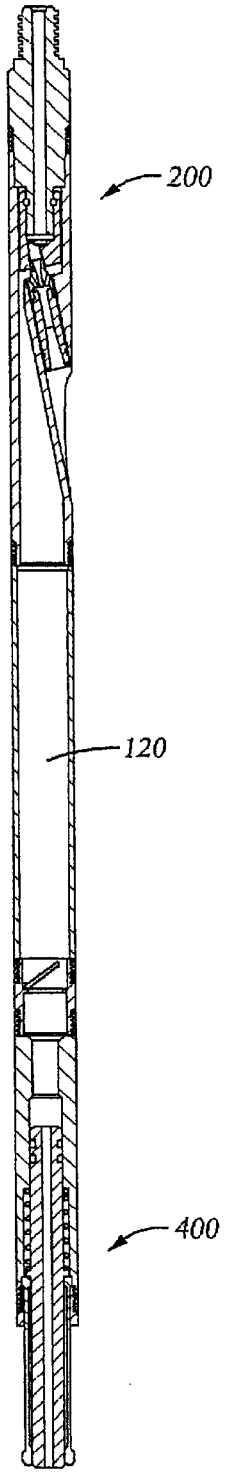
FIG. 8 is a section view of the present invention including a retrieval tool disposed at a lower end thereof.

FIG. 8 is a section view of the present invention including a retrieval tool disposed at a lower end thereof. The retrieval tool 400 is installed at the end of the debris removal tool 200 and relies upon the same venturi forces for operation as are utilized by the debris removal tool 200. Retrieval tools are well known in the art and are used to retrieve downhole devices like plugs, bridge plugs and packers that have been fixed temporarily in the wellbore but are designed for removal and are fitted with some means for attachment to a retrieval tool. The combined apparatus including the debris removal tool 200 and retrieval tool 400 are run into a well together in order to clear debris from the surface of a downhole device in the wellbore and then retrieve the device and bring it back to the surface of the well. The apparatus of the invention allows both of these operations to be completed in one time-saving trip into the wellbore.

Figure 9:
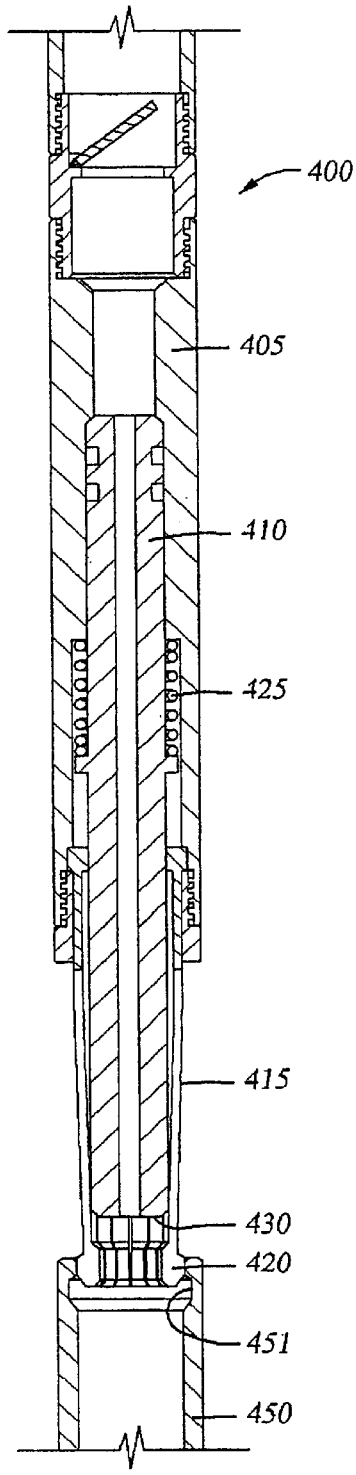
FIG. 9 is a section view of the retrieval tool in an actuated, retracted position.
Figure 10:
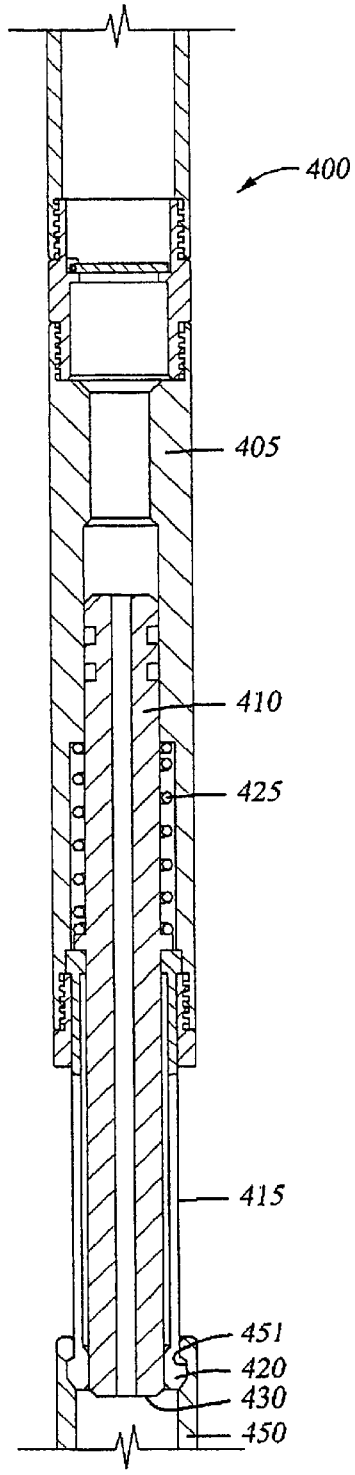
FIG. 10 is a section view of the retrieval tool in a un-actuated, extended position.

FIGS. 9 and 10 are section views showing the retrieval tool 400 in its actuated (FIG. 9) and un-actuated (FIG. 10) positions. The tool 400 includes an outer body 405, a slidable member 410 and a collet member 415 disposed between the outer body 405 and the slidable member 410. The collet member 415 is equipped with fingers at a downhole end. Fingers 420 are designed to flex inward when the tool is actuated and to be prevented from inward flexing by the slidable member 410 when the tool is in the extended position. A biasing member 425 biases the slidable member in a normally extended, position as depicted in FIG. 10. In order to actuate the tool 400 and cause it to assume the retracted position shown in FIG. 9, a venturi device thereabove as depicted in FIG. 8 is operated creating a suction therebelow. The suction, in addition to gathering debris into the container as herein described, can also act upon a piston surface 430 formed at the downhole end of the retrieval tool, causing the inner member 410 to act against the biasing member 425 and the tool to assume a retracted position.

In operation, the retrieval tool 400 is run into the well along with the debris removal tool 200. At a predetermined depth where debris is encountered, the debris removal tool 200 is operated and the debris removed from the wellbore and urged into the container 120 of the debris removal tool 200. Throughout this operation, the retrieval tool 400 will be in an actuated, retracted position as shown in FIG. 9, its inner member urged upwards against the biasing member 425 by the suction force created in the debris removal tool 200 thereabove. After the debris has been contained and a downhole device 450 exposed for retrieval, the retrieval tool 400, still in the actuated position, is inserted into a receiving member of the downhole device. Typically, the receiving member of the downhole device will include at least one profile 451 formed therein to interact with the fingers 420 of the retrieval tool 400. The fingers 420 easily flex in order for the retrieval tool 400 to be inserted into the device 450. Thereafter, the venturi device stops operating and the retrieval tool 400 returns to its normally extended position, preventing the fingers from flexing inward and locking the retrieval tool to the downhole device. The device 450 can then be removed by upward or rotational force or a combination thereof and raised to the top of the well along with the tools 200, 400.

In the embodiment described, the retrieval tool operates by communicating with a profile formed upon the inner surface of the downhole device. However, the tool could also operate with a downhole device having a profile formed on the outside thereof. In this case, the collet fingers would be prevented from inward flexing movement by the inner member.

Figure 11:
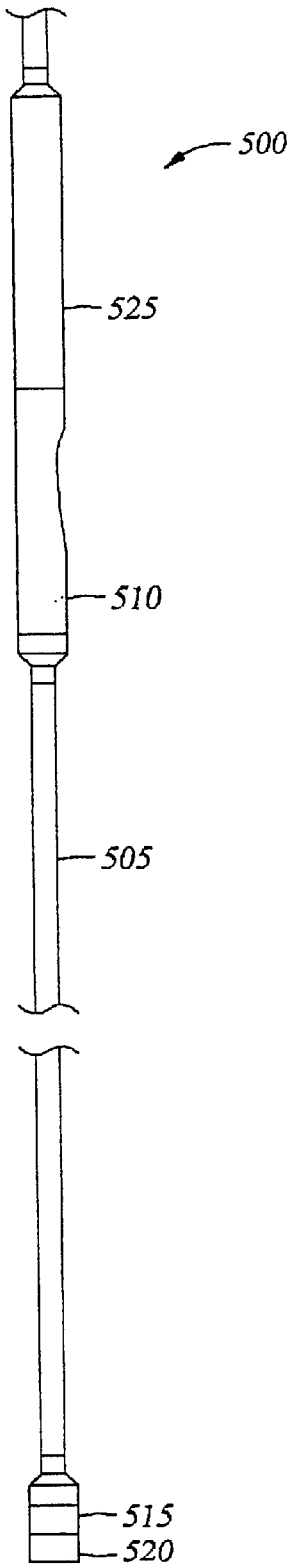
FIG. 11 depicts the debris removal tool of the present invention with coiled tubing disposed therein as a debris container.

Use of the debris removal tool of the present invention can be performed using a predetermined and measured length of coiled tubing as a debris container, whereby the tool can be easily and economically custom made for each debris removal job depending upon the amount of debris to be removed for a particular wellbore. FIG. 11 depicts a debris removal tool 500 with a length of coiled tubing 505 disposed within as a debris container. Rather than a permanent container like those depicted in FIGS. 1 & 2, the debris container in FIG. 11 is formed of coiled tubing that has been cut to length at the well surface and installed between the venturi portion 510 of the debris removal tool 500 and the filter 515 and one way valve 520 thereof.

In a preferred embodiment, a motor head 525 is inserted between the venturi portion and the coiled tubing thereabove, the motor head typically including connectors, double flapper check valves to prevent pressurized fluid from returning to the well surface and a hydraulic disconnect (not shown). The assembled apparatus can then be lowered into a wellbore to a predetermined depth proximate formation debris to be removed. The venturi apparatus is then operated, causing a suction and urging debris into the coiled tubing portion between the venturi 510 and the one way valve 520.

Figure 12:
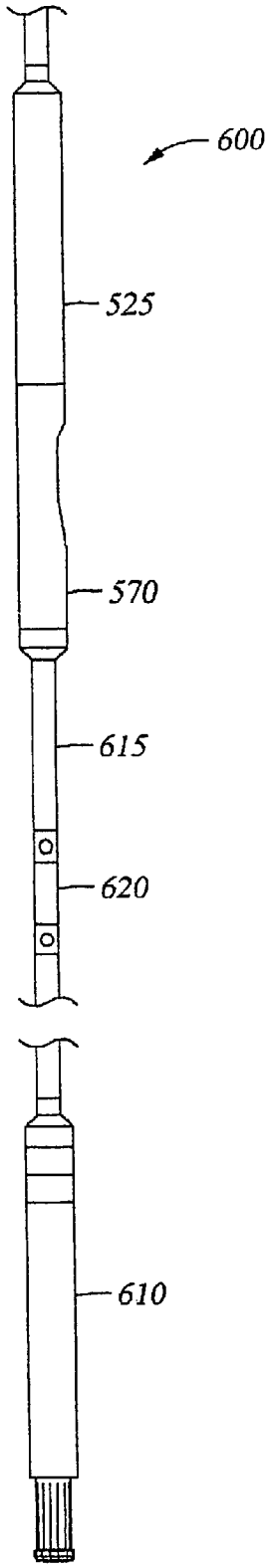
FIG. 12 is the tool of FIG. 11 with a spoolable, double valve disposed within the length of coiled tubing and a retrieval tool disposed at the lower end of the tubing.

FIG. 12 is a view of a debris removal tool 600 with a retrieval tool 610 disposed therebelow and a length of coiled tubing 615 disposed therebetween. Like the apparatus of FIG. 11, the coiled tubing 615 is used as a debris container and is measured and sized depending upon the amount of debris to be removed. In addition, a spoolable, double valve 620 is inserted in the coiled tubing string. The purpose of the spoolable, double valve is to facilitate the isolation of areas above and below the valve when debris and/or a downhole device is removed from a live well as described below. Because the double valve is spoolable, it can be wound on and off of a reel without being removed from a string of coiled tubing. In the preferred embodiment, the valves making up the double valve are ball valves. However, any type valve could be used so long as it is tolerant of stresses applied during reeling and unreeling with coiled tubing.

Figure 13:
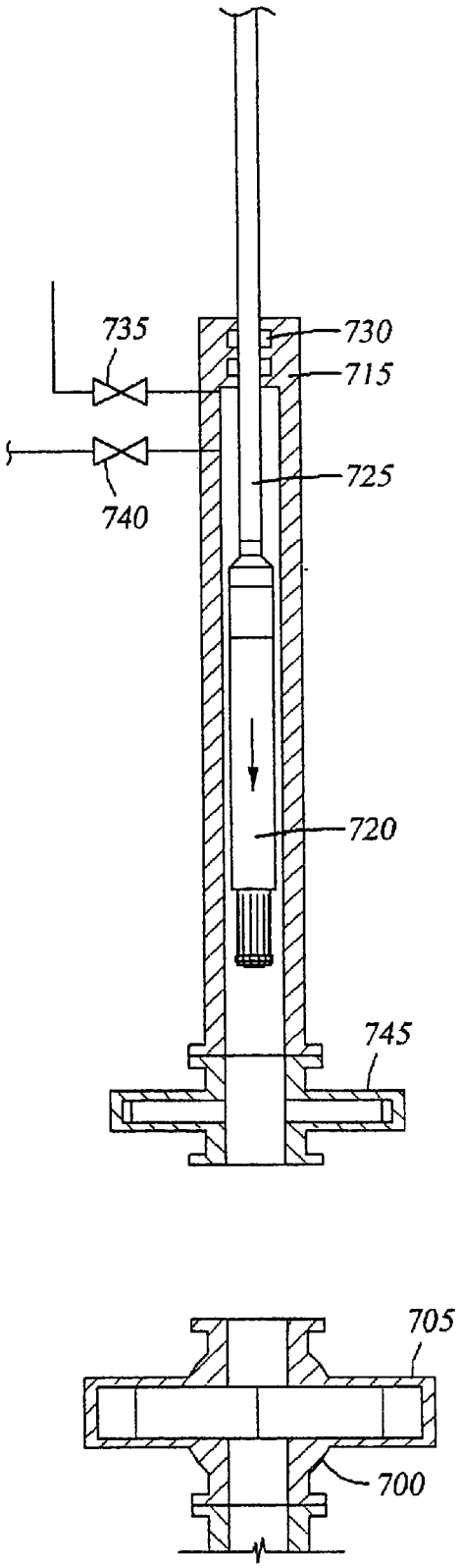
FIG. 13 is a section view showing a wellhead with a lubricator thereabove and a device retrieval tool disposed therein, the lubricator being installed on the wellhead.
Figure 14:
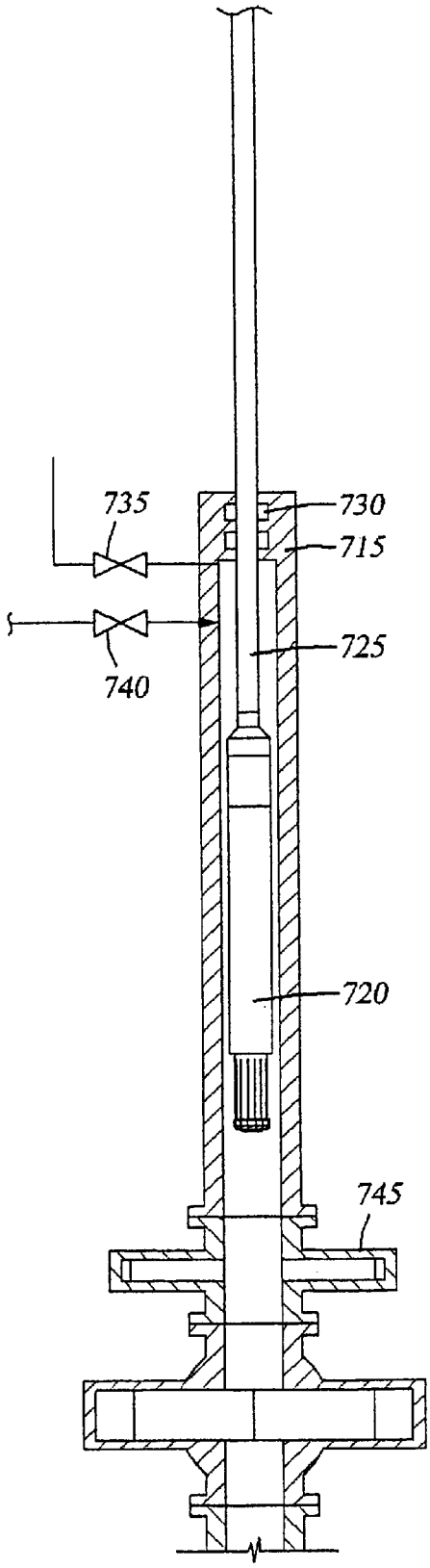
FIG. 14 is a section view of the wellhead with the lubricator installed thereupon, the lubricator being pressurized to the pressure of the wellbore.

FIG. 13 is a section view showing a wellhead 700 with a blind ram 705 in a closed position and a lubricator 715 disposed thereabove with a retrieval tool 720 at the end of a coiled tubing string 725 disposed therein. The lubricator 715 is a pressure vessel which can be pressurized to the pressure of the wellbore and placed in fluid communication with the wellbore. At an upper end of the lubricator 715, a stripper 730 allows coiled tubing to move in and out of the lubricator, maintaining a pressurized seal therewith. Valves 735, 740 are provided at an upper end of the lubricator for pressurizing and bleeding pressure. FIG. 14 is a section view showing the wellhead 700 with the lubricator 715 attached thereto. The lubricator 715 is pressurized via valve 740 to wellbore pressure by an external source of pressure. In the preferred embodiment, the retrieval tool 720 within the lubricator 715 includes a meltable plug (not shown) disposed in the end thereof. The plug is made of a substance which, at ambient temperature is a solid that seals the interior of the tool to external pressure. The plug is designed to melt and disintegrate at temperatures found in the wellbore where the debris removal will take place.

Figure 15:
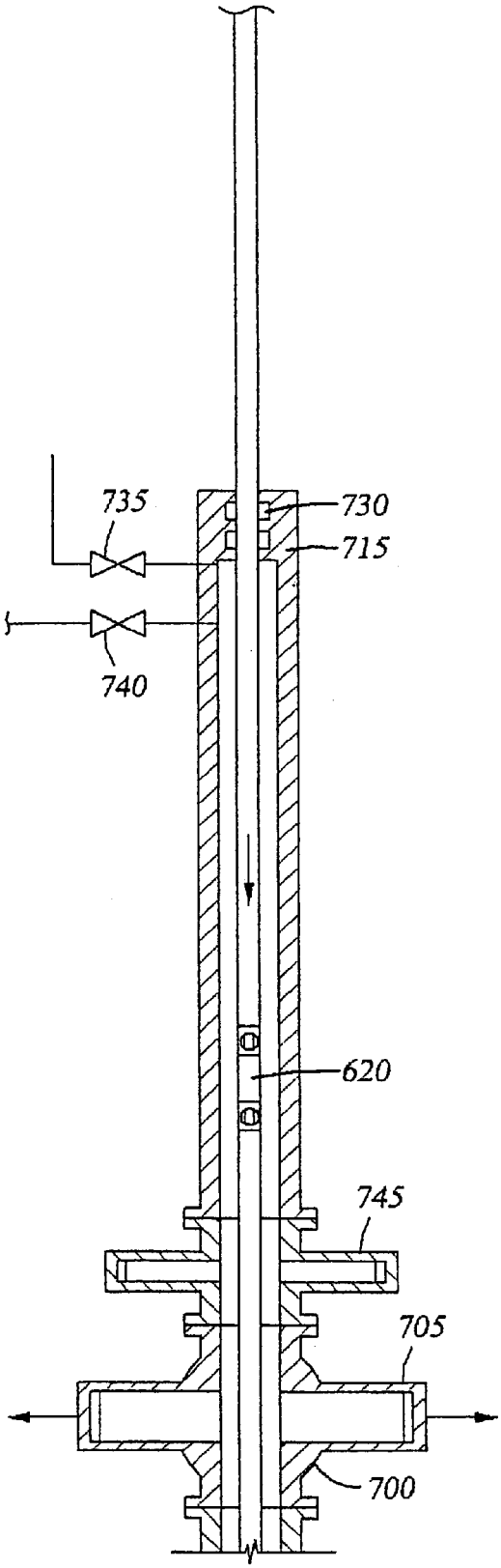
FIG. 15 is a section view of the wellhead with a blind ram opened, the retrieval tool having been lowered in the well and a double valve in the coiled tubing string in the lubricator.
Figure 16:
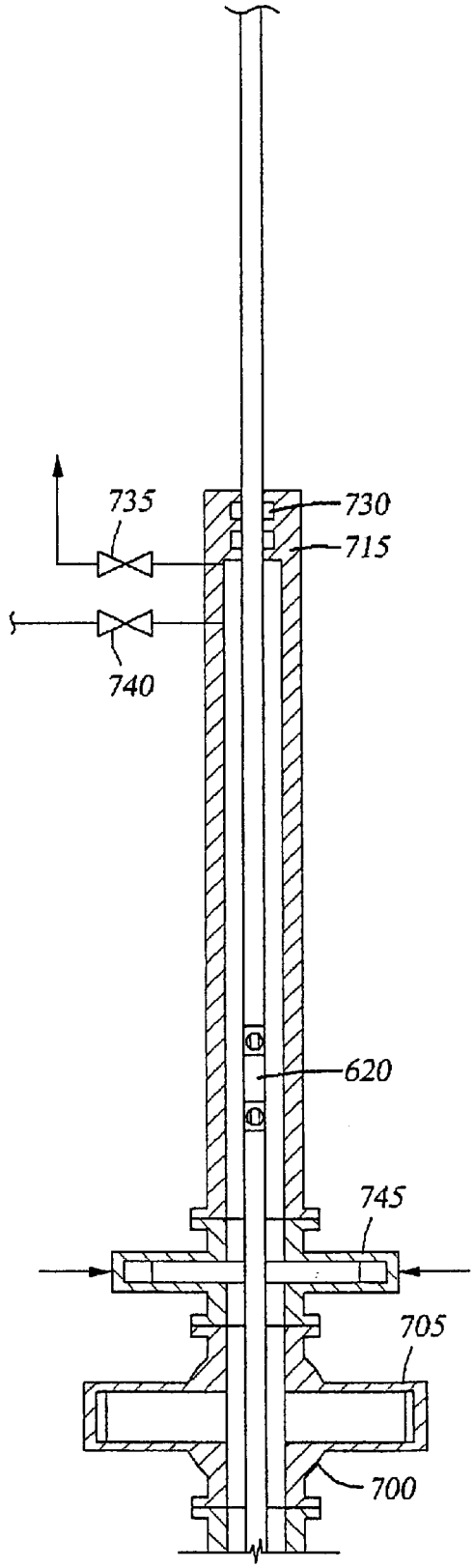
FIG. 16 is a section view of the wellhead with a lower pipe ram in a closed position and the lubricator pressurized to atmospheric pressure.

FIG. 15 is a section view showing the wellbore opened and the retrieval tool lowered into the wellbore a predetermined distance. Double valve 620, inserted in the string of coiled tubing 615, is at a location within the lubricator 715. FIG. 16 is a section view of the apparatus with a lower pipe ram 745 in the closed position and thereafter, the pressure in the lubricator bled off via valve 735.

Figure 17:
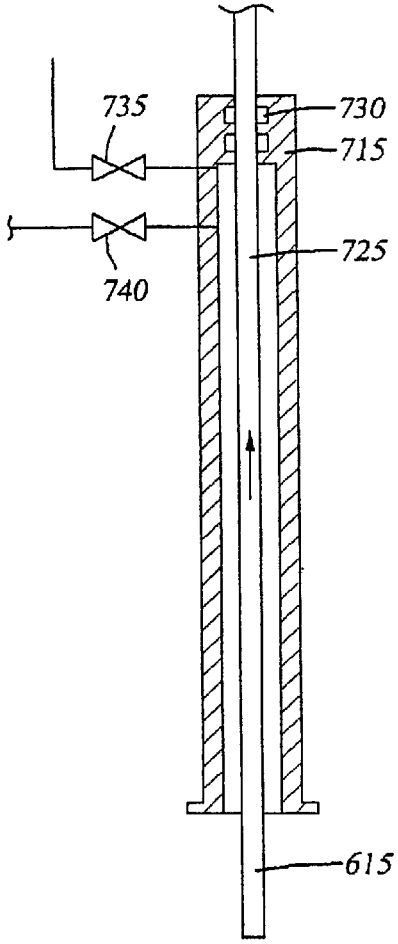
FIG. 17 is a section view illustrating the wellhead with the lubricator having been lifted therefrom exposing the double valve and the coiled tubing severed thereabove.
Figure 17:
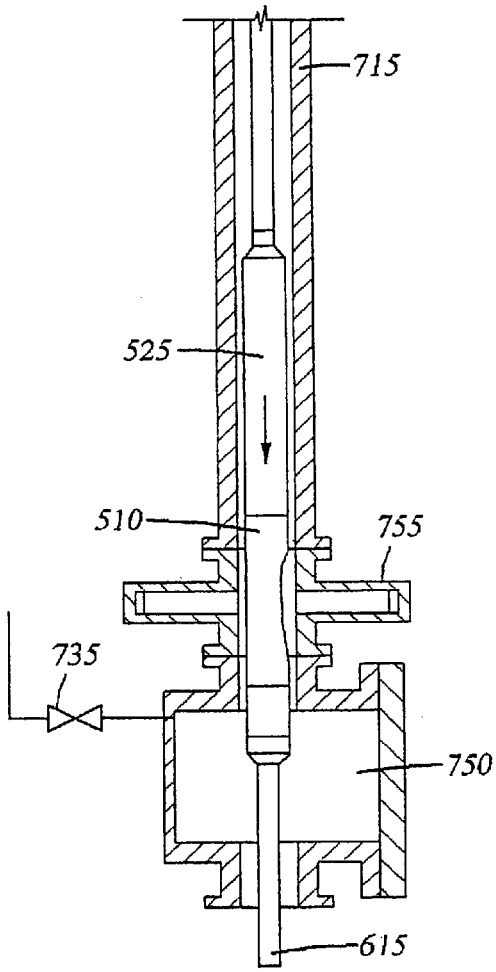
Figure 17:
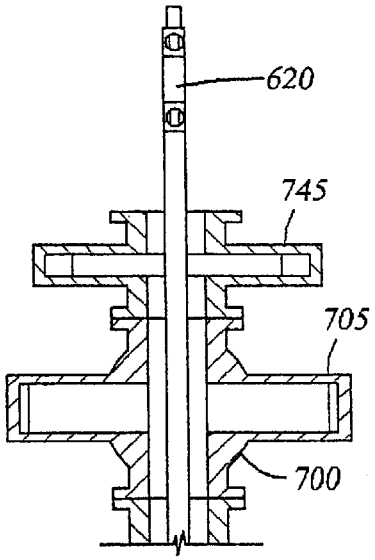
Figure 18:
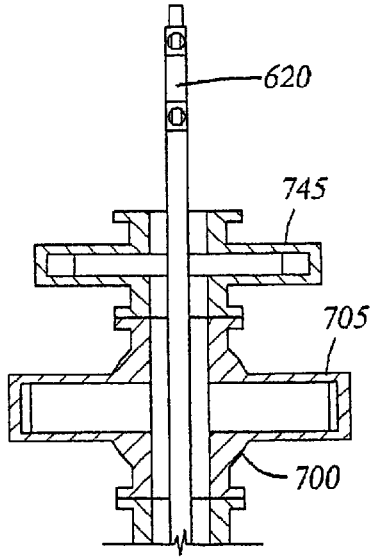
FIG. 18 is a section view of the wellhead with debris removal tool inserted into the coiled tubing string and an access port installed therebelow.
Figure 19:
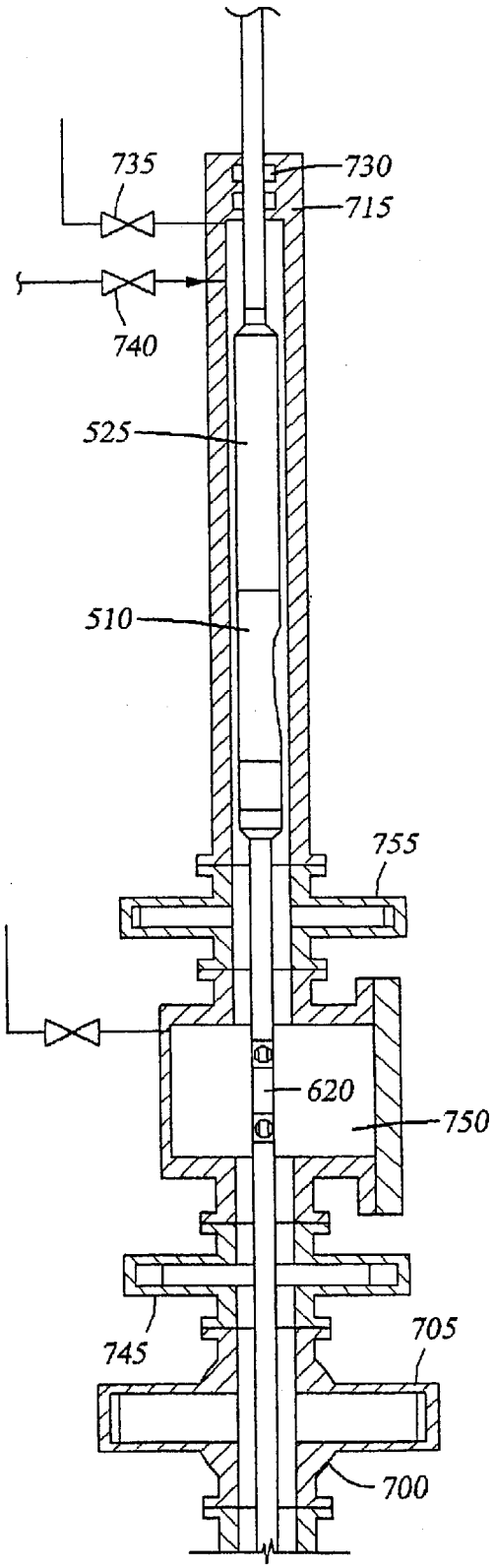
FIG. 19 is a section view of the wellhead with the coiled tubing in the lubricator having been reattached to the coiled tubing in the wellhead, the upper pipe ram closed and the lubricator pressurized to the pressure of the wellbore.
Figure 20:
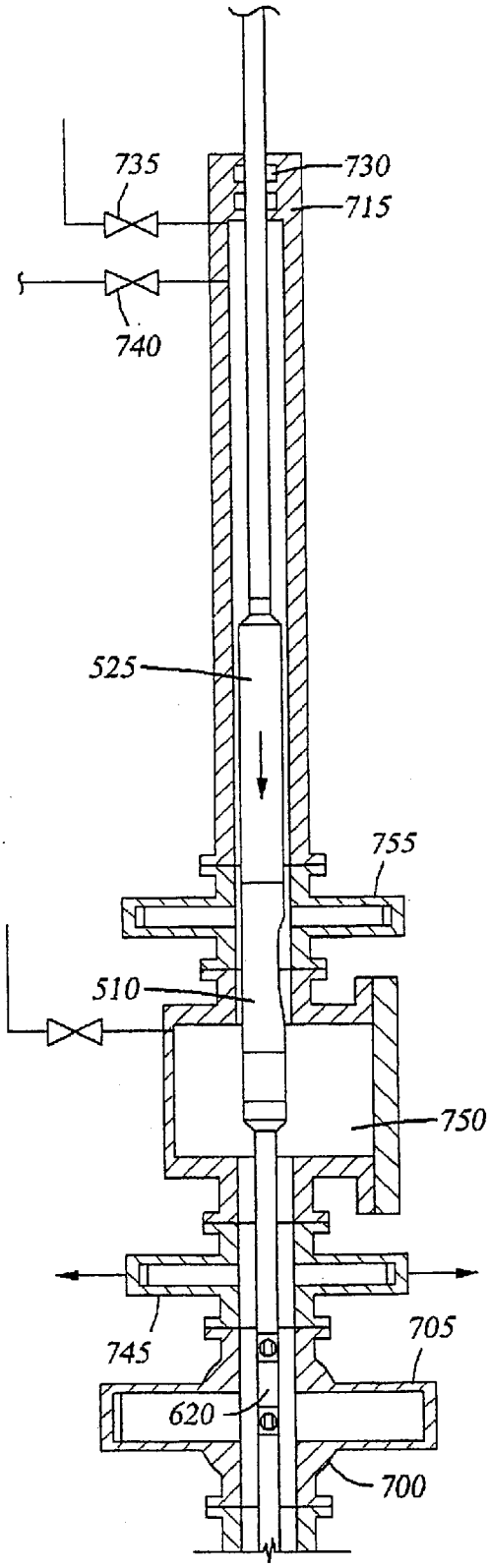
FIG. 20 is a section view of a wellhead, the access port pressurized to the pressure of the wellbore and the upper and lower pipe rams opened.

FIG. 17 is a section view of the wellhead 700 with the lubricator 715 and raised thereabove. The coiled tubing string 615 has been severed above the double valve 620. FIG. 18 illustrates the assembly with the debris removal tool 510 and motor head 525 disposed within the lubricator 715 and an additional access port 750 and upper ram 755 added to the lubricator. FIG. 19 is a section view wherein the lubricator 715, upper pipe ram 755 and access port 750 have been attached to the wellhead 700 with the lower pipe ram 745 closed. The lubricator 715 is pressurized via valve 740 to the pressure of the wellbore. FIG. 20 is a section view wherein the lower pipe ram 745 is open and the debris removal tool is lowered into the wellbore sufficient distance to place the retrieval tool therebelow in the area of the debris to be removed.

In the preferred embodiment, the retrieval tool is lowered into the well with a length of coiled tubing there behind sufficient and volume to house the debris which will be removed from the wellbore. After a sufficient amount of coiled tubing has been lowered into the well behind the retrieval tool, the venturi apparatus with its double safety valve is installed in the coiled tubing. As the retrieval tool reaches that location in the wellbore where it will be removed, the temperature present in the wellbore causes the plug in the end of the retrieval tool to melt by exposing the coiled tubing section to wellbore pressure and permitting communication between the venturi apparatus and the debris containing wellbore.

Figure 21:
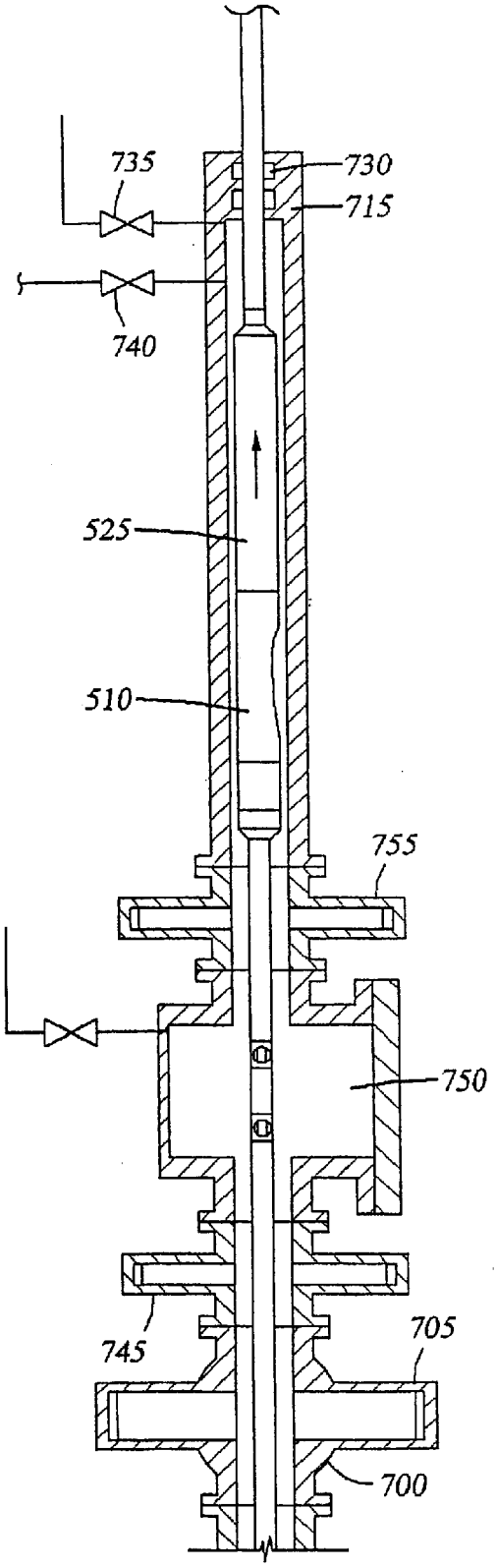
FIG. 21 is a section view of the wellhead after the debris removal and device retrieval is completed, the debris removal tool raised into the lubricator and the double valve housed within the access port.
Figure 22:
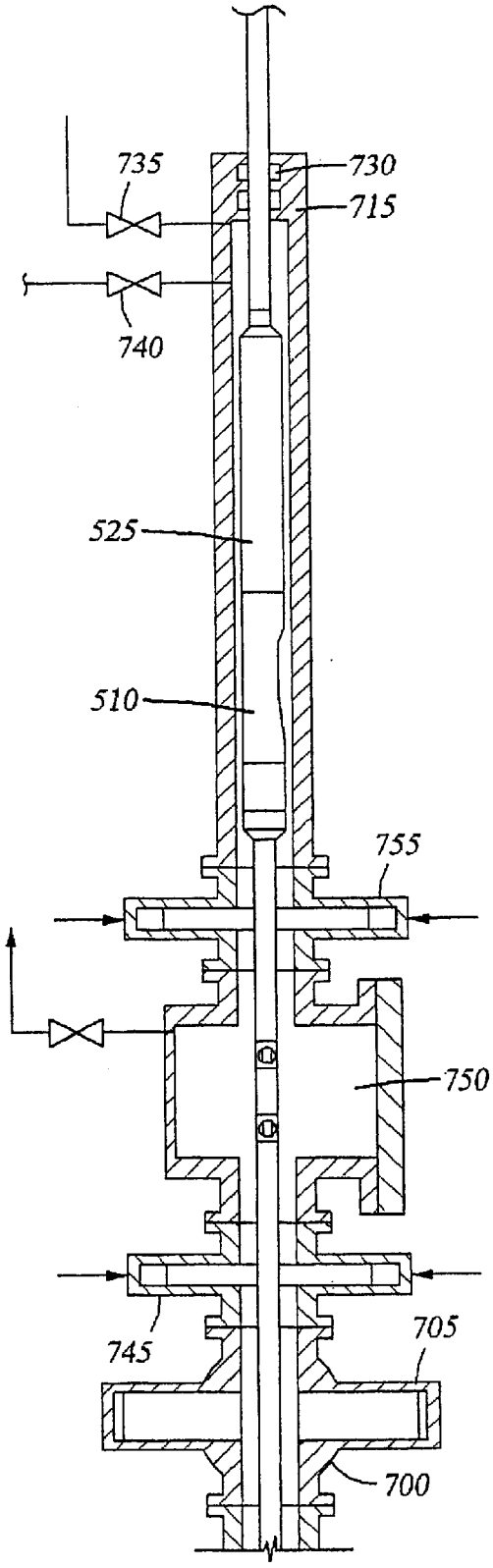
FIG. 22 is a section view of the wellhead wherein the upper and lower pipe rams have been closed and the access port has been pressurized to atmospheric pressure.

FIG. 21 depicts the wellhead assembly after the debris removal and device retrieval has been completed and the debris removal tool 510 has been raised out of the wellbore and is housed again in the lubricator 715. Visible specifically in FIG. 21 is the double valve 620, still in its opened position and raised to a location where it is accessible through the access port 750. FIG. 22 is a section view depicting the upper pipe ram 755 between the access port 750 and the lubricator 715 in a closed position and the lower pipe ram 745 between the access port 750 and the wellhead 700 also in a closed position in order to isolate the access port 750. As depicted in the figure, with the access port 750 isolated above and below, pressure is bled therefrom.

Figure 23:
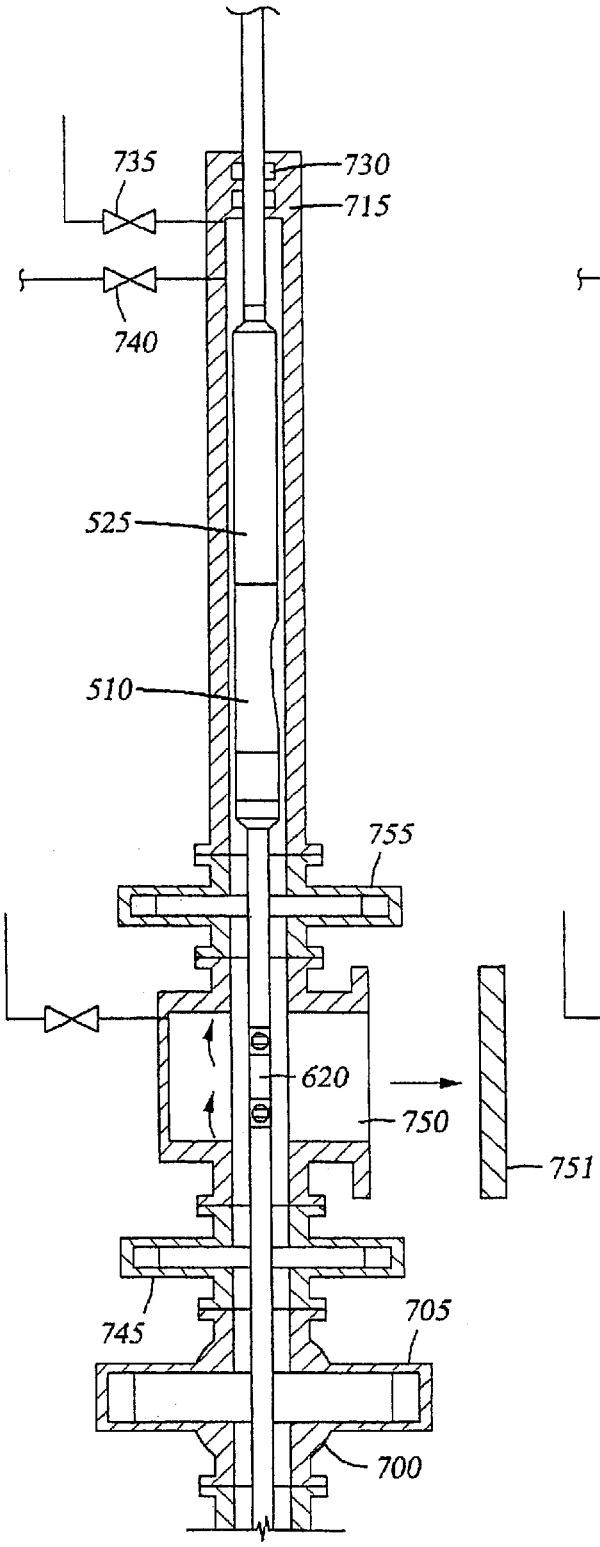
FIG. 23 is a section view of the wellhead showing a blind flange removed from the access port and the double valve adjusted to the closed position.
Figure 24:
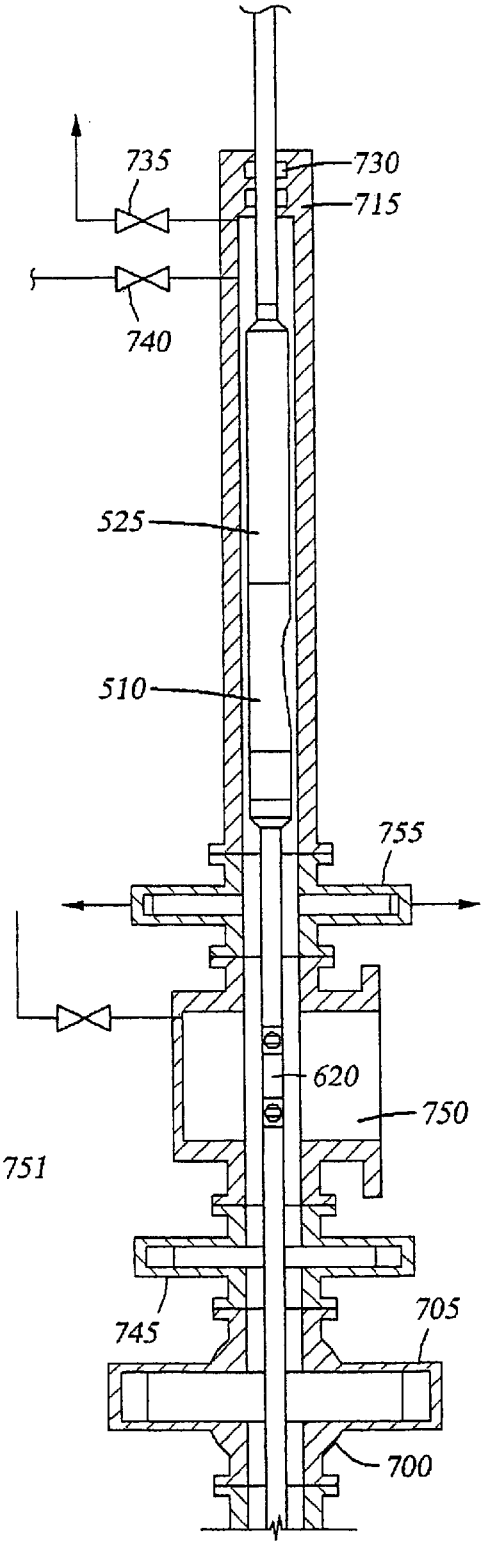
FIG. 24 is a section view of the wellhead showing the lubricator pressurized to atmospheric pressure and, thereafter, the upper pipe ram opened.
Figure 25:
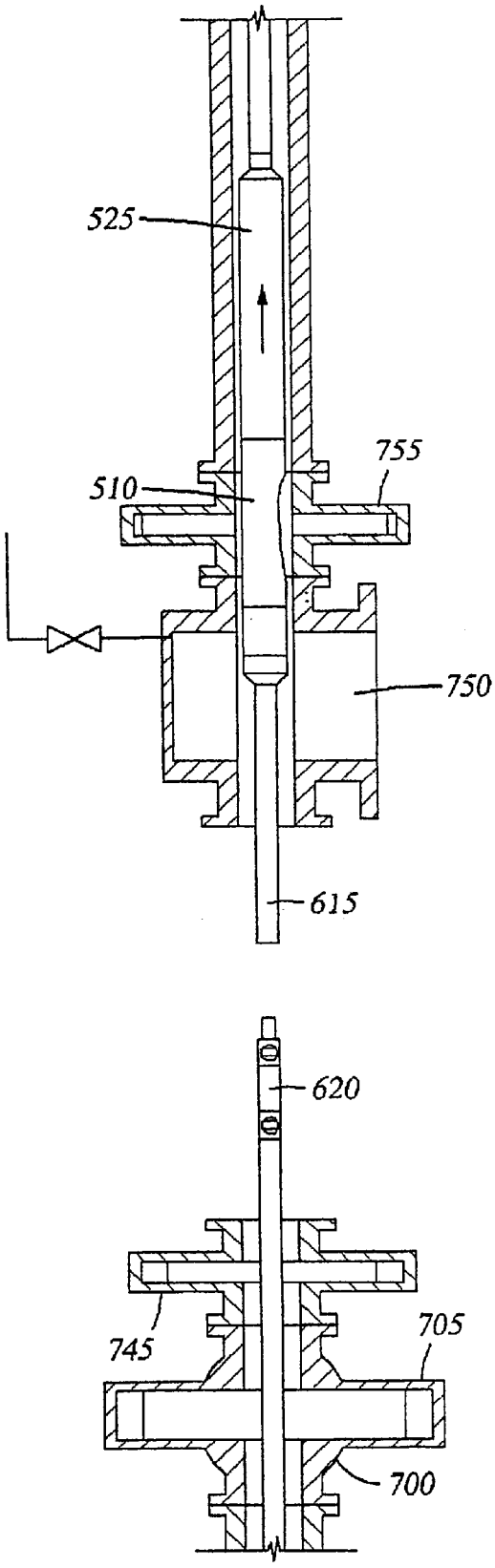
FIG. 25 is a section view of the wellhead showing the lubricator and debris removal tool removed from the wellhead, the coiled tubing severed above the double valve.

FIG. 23 is a section view depicting an access plate 751 removed from the access port 750 and the double valve 620 manipulated to a closed position. FIG. 24 is a section view of showing the pressure bled from the lubricator 715 via valve 735. FIG. 25 depicts the lubricator 715 and access port 750 having been removed from the wellhead 700, exposing the double valve 620, the coiled tubing 615 thereabove having been severed.

Figure 26:
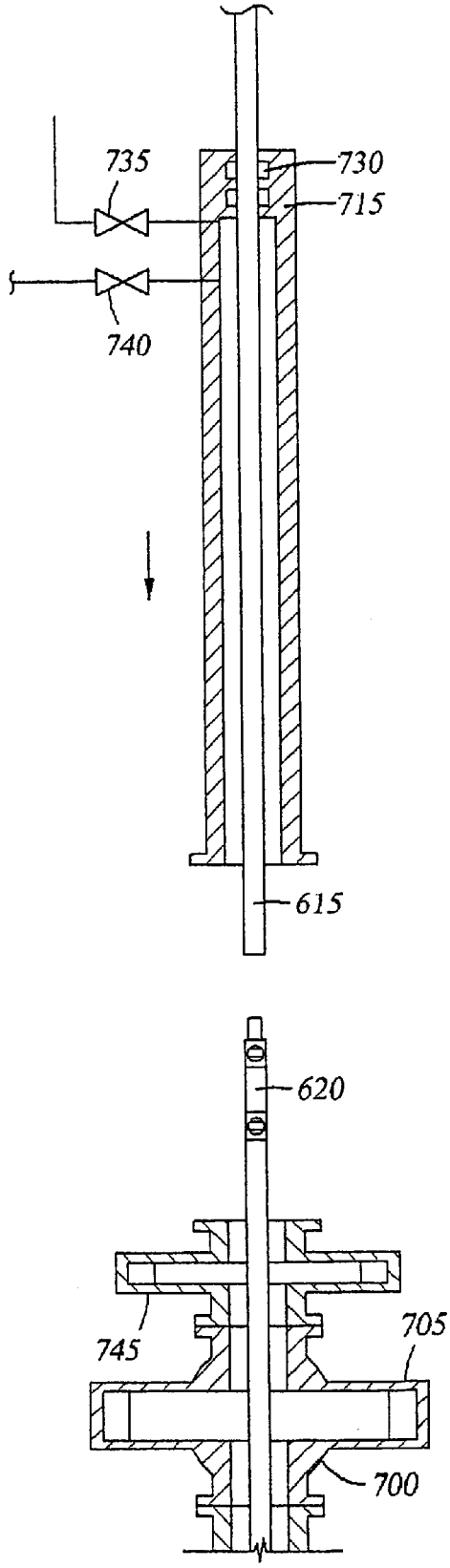
FIG. 26 is a section view of the wellhead showing the lubricator with the debris removal tool having been removed therefrom and a length of coiled tubing disposed within for connection to the coiled tubing extending from the wellhead therebelow.
Figure 27:
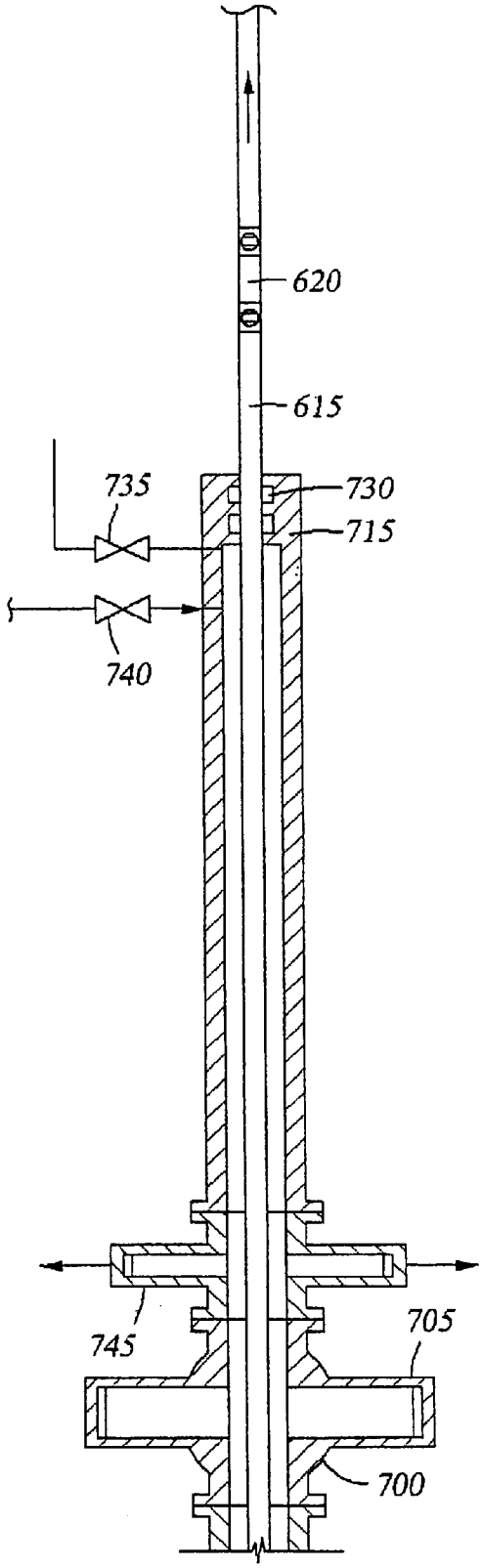
FIG. 27 is a section view of the wellhead showing the lubricator pressurized to the pressure of the wellbore and thereafter, the lower pipe ram opened.

FIG. 26 depicts the lubricator 715 with the debris removal tool 510 removed therefrom, leaving only a string of coiled tubing 615 in the lubricator 715. As depicted in the figure, the coiled tubing string in the lubricator can now be reconnected to the coiled tubing string extending from the double valve 620, which remains in the closed position. FIG. 27 is a section view depicting the lubricator 715 having been reconnected to the wellhead 700 and pressurized to wellbore pressure via valve 740. Thereafter, the lower pipe ram 745 is opened and, as illustrated by the directional arrow, the coiled tubing string 615 is retracted from the wellbore.

Figure 28:
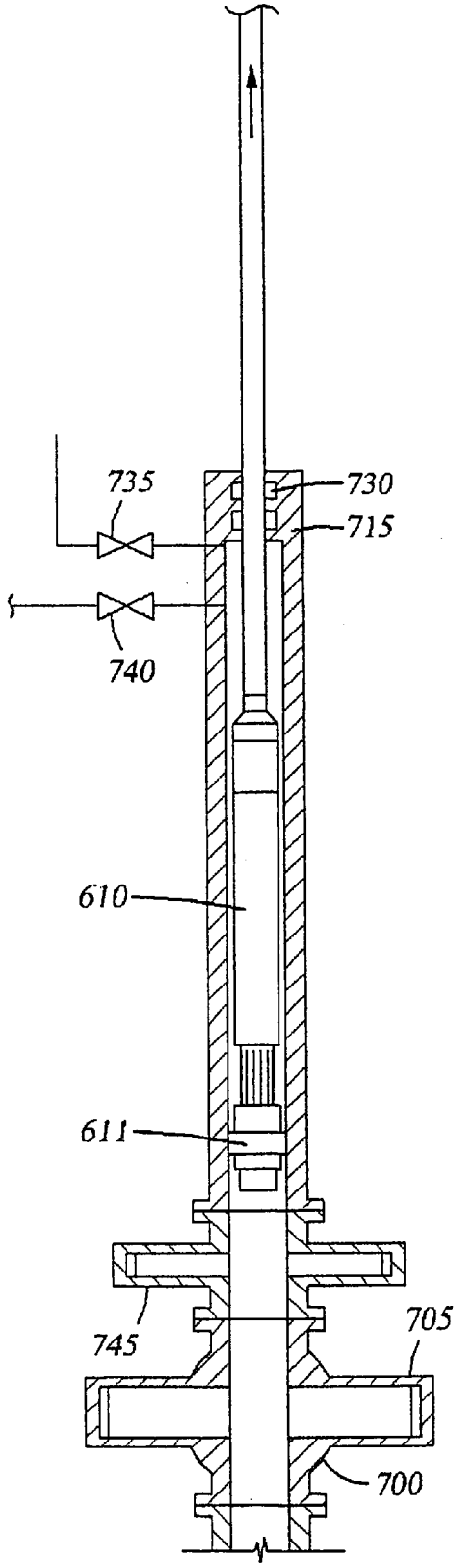
FIG. 28 is a section view of the wellhead showing the retrieval tool with the retrieved device lifted from the well and disposed within the lubricator.
Figure 29:
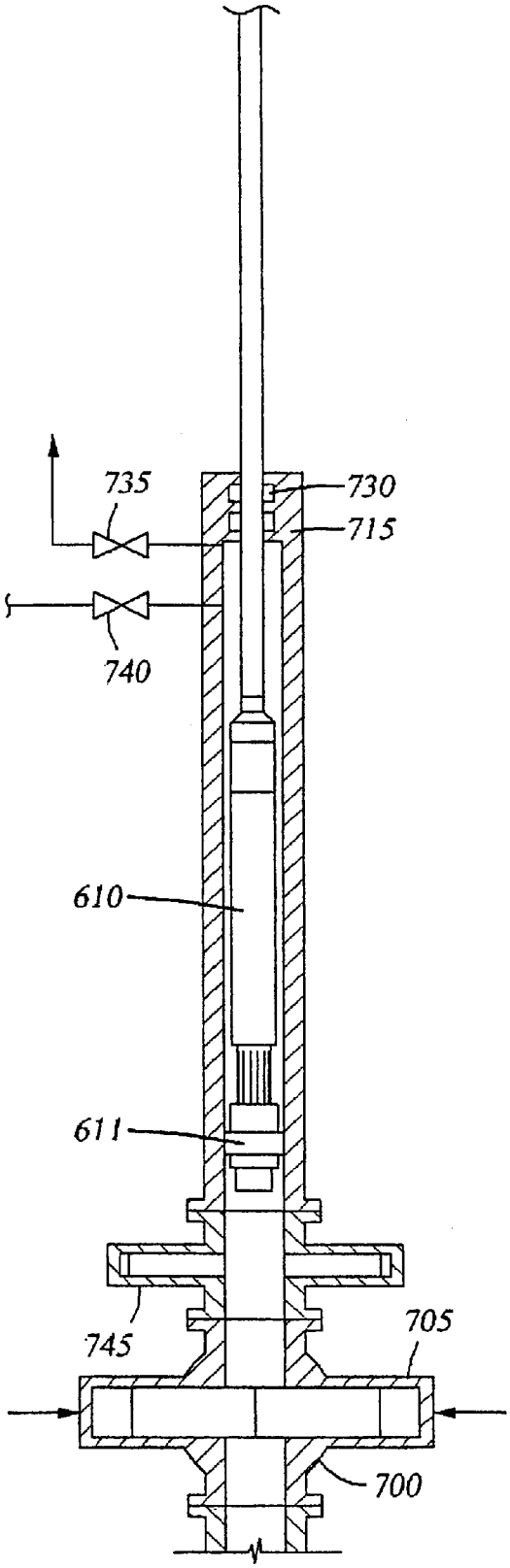
FIG. 29 is a section view of the wellhead showing a blind ram in a closed position.
Figure 30:
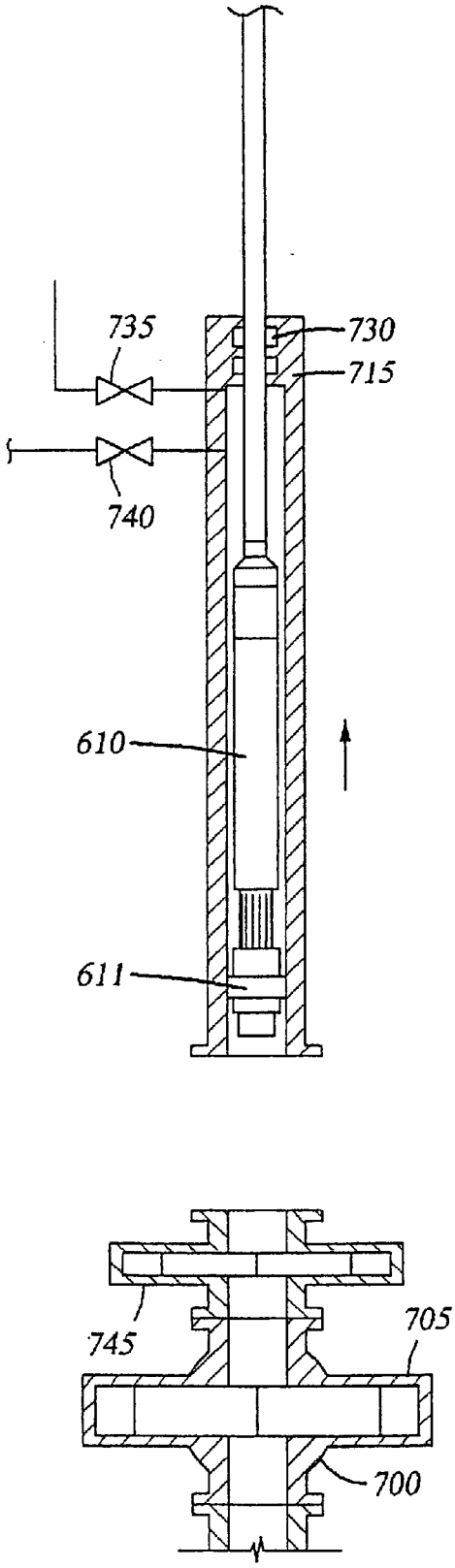
FIG. 30 is a section view of the wellhead showing the lubricator with the retrieval tool and retrieved device disposed therein and removed from the wellhead.

FIG. 28 is a section view wherein the retrieval tool 610 and downhole device 611 has been lifted from the wellbore and is housed within the lubricator 715. FIG. 29 is a section view wherein the blind ram 705 has been closed and, thereafter, the pressure within the lubricator 715 is bled via valve 735. FIG. 30 is a section view wherein the lubricator

715, the retrieval tool 610 and downhole device 611 have been removed from the wellhead 700 and the debris removal and tool retrieval procedure is completed, leaving the wellhead 700 with the blind ram 705 in the closed position.

As described in the forgoing, the invention solves problems associated with prior art sand removal tools and provides an efficient, flexible means of removing debris or retrieving a downhole device from a live or dead well. The design of the tool is so efficient that tests have demonstrated a suction created in the tool measured at 28" of mercury, compared with a measure of as little as 3–5" of mercury using a prior art device like the one shown in FIG. 1.

While foregoing is directed to the preferred embodiment of the present invention, other and further embodiments of the invention may be devised without departing from the basic scope thereof, and the scope thereof is determined by the claims that follow.

What is claimed is:

1. A method of removing debris from a well with a tool having a venturi portion, a coiled tubing string for containing debris and an intake portion disposed therebelow, the method comprising the steps of:

housing the intake portion in a pressure vessel at the surface of the well, the intake portion sealed to pressure at a lower end thereof;

pressurizing the pressure vessel to wellbore pressure;

exposing the pressure vessel to wellbore pressure;

lowering the intake portion into the wellbore on a the coiled tubing string, the coiled tubing string including a spoolable valve therein, the valve in an open position;

sealing the wellbore around the coiled tubing string;

installing the housing the venturi portion on the coiled tubing string and housing the venturi portion in the pressure vessel;

pressurizing the pressure vessel to wellbore pressure;

exposing the pressure vessel to wellbore pressure;

lowering the venturi portion into the wellbore to a point whereby the intake portion is proximate debris to be removed from the well; and operating the tool by injecting pressurized fluid therein to cause the debris to enter the container portion.

* * * * *